US006366012B1

(12) United States Patent
Lee et al.

(10) Patent No.: US 6,366,012 B1
(45) Date of Patent: Apr. 2, 2002

(54) CATHODE RAY TUBE HAVING A LIGHT ABSORBING FILTER LAYER FORMED ON A GLASS PANEL THEREOF

(75) Inventors: Jong-Hyuk Lee, Seoul; Jung-Hwan Park, Suwon; Yoon-Hyung Cho; Hae-Sung Lee, both of Seoul; Dong-Sik Zang, Suwon, all of (KR)

(73) Assignee: Samsung SDI Co., Ltd., Kyungki-Do (KR)

( * ) Notice: Subject to any disclaimer, the term of this patent is extended or adjusted under 35 U.S.C. 154(b) by 0 days.

(21) Appl. No.: 09/559,523

(22) Filed: Apr. 28, 2000

(30) Foreign Application Priority Data

Aug. 19, 1999 (KR) ..... 99-34356

(51) Int. Cl.[7] ..... H01J 29/28; H01J 29/89

(52) U.S. Cl. ..... 313/466; 313/479; 313/477 R; 428/922

(58) Field of Search ..... 313/370, 371, 313/461, 477 R, 478, 479, 466, 474; 428/922, 323; 501/127, 134, 133, 103; 430/27

(56) References Cited

U.S. PATENT DOCUMENTS

| | | | | |
|---|---|---|---|---|
| 4,019,905 A | | 4/1977 | Tomita et al. | |
| 4,132,919 A | | 1/1979 | Maple | |
| 4,157,215 A | * | 6/1979 | Hanak | 354/1 |
| 4,822,673 A | * | 4/1989 | Umemura | 428/328 |
| 5,068,568 A | | 11/1991 | de Vrieze et al. | |
| 5,179,318 A | | 1/1993 | Maeda et al. | |
| 5,200,667 A | | 4/1993 | Iwasaki et al. | |
| 5,218,268 A | | 6/1993 | Matsuda et al. | |
| 5,315,209 A | | 5/1994 | Iwasaki | |
| 5,627,429 A | | 5/1997 | Iwasaki | |
| 5,756,197 A | * | 5/1998 | Statz et al. | 428/323 |
| 5,874,801 A | * | 2/1999 | Kobayashi et al. | 313/478 |
| 6,143,418 A | * | 11/2000 | Takamiya et al. | 428/434 |

FOREIGN PATENT DOCUMENTS

| | | |
|---|---|---|
| JP | 0 848 386 | 6/1998 |
| JP | 0 890 974 | 1/1999 |
| WO | WO 99 01883 | 1/1999 |

* cited by examiner

*Primary Examiner*—Nimeshkumar D. Patel
*Assistant Examiner*—Karabi Guharay
(74) *Attorney, Agent, or Firm*—Lowe Hauptman Gilman & Berner, LLP

(57) ABSTRACT

A CRT has an improved contrast with the provision of a filter layer where nano-sized metal particles and colored particles are dispersed in a dielectric matrix to selectively absorb light in predetermined wavelengths, specifically wavelengths between peak wavelengths of primary colors emitted by phosphors coated on the inner surface of the faceplate. The improved contrast is a result of the metal particles in a dielectric matrix resonating with particular wavelengths and thus absorbing them.

27 Claims, 5 Drawing Sheets

CATHODE RAY TUBE HAVING A LIGHT ABSORBING FILTER LAYER FORMED ON A GLASS PANEL THEREOF

FIELD OF THE INVENTION

The present invention is related to a CRT and, more particularly, to its face plate having a light absorbing filter layer having a predetermined absorption peak/peaks.

BACKGROUND OF THE PRESENT INVENTION

FIG. 1 shows a partial cross-section of a conventional CRT face plate having a glass panel 10 with a phosphor layer 12 coated thereon. A black matrix 13 is formed between the glass panel 10 and the phosphor layer 12. The face plate is also provided with a metal layer 15 for reflecting light emitted by the phosphor layer 12 toward the glass panel 10. There are two sources of visible light coming out of the face panel. One is a light 1 emitted from phosphors when electron beams impinge on them. The other is external ambient light reflected from the face panel. The reflected light has in turn two components depending on where the incident external light is reflected. The first component 2 is that reflected on the surface of the face panel. The other component 3 is that passes the whole thickness of the face panel but is reflected off at the phosphor surface. The ambient light reflected from the face plate has a uniform spectrum, degrading contrast of a CRT since the CRT is designed to emit light at only predetermined wavelengths and to display a color image by a selective combination of these predetermined wavelengths.

FIG. 2 shows is a spectral luminescence of P22 phosphor materials commonly used in the art. Blue phosphor ZnS:Ag, green phosphor ZnS:Au,Cu,Al and red phosphor $Y_2O_2S$:Eu have their peak wavelengths 21, 22, 23 at 450 nm, 540 nm and 630 nm respectively. Reflected light components 2,3 have relatively higher illumination between these peaks since their spectral distribution is flat across all the visible wavelengths. Spectrum of light emitted from the blue and green phosphor has relatively broad bandwidths and thus some of wavelengths, from 450–550 nm, are emitted from both of the blue and green phosphors. The spectrum of red phosphor has undesirable side bands around 580 nm, at which wavelength the luminous efficiency is high. Therefore selective absorption of light in the wavelengths of 450–550 nm and around 580 nm would greatly improve contrast of a CRT without sacrificing luminescence of phosphors. By the way, because absorption of light around 580 nm makes the body color of a CRT appear bluish, external ambient light around 410 nm is preferably made to be absorbed in order to compensate for the bluish appearance.

Efforts have been made to find a way to selectively absorb light around 580 nm, 500 nm and 410 nm. For instance, U.S. Pat. Nos. 5,200,667, 5,315,209 and 5,218,268 all disclose forming on a surface of the face plate a film containing dye or pigments that selectively absorb light. Alternatively, a plurality of transparent oxide layers having different refraction and thickness were coated on the outer surface of a face plate to take advantage of their light interference for the purpose of reducing ambient light reflection. However, these patents fail to reduce light reflected off at the phosphor layer. So an intermediate layer was proposed, in U.S. Pat. Nos. 4,019,905, 4,132,919 and 5,627,429, to be coated between the inner surface of the faceplate and the phosphor layer, absorbing predetermined wavelengths. Further U.S. Pat. Nos. 5,068,568 and 5,179,318 disclose an intermediate layer comprised of layers of high refraction and low refraction alternately.

SUMMARY OF THE PRESENT INVENTION

An objective of the present invention is to minimize the ambient light reflection by dispersing both minute metal particles and coloring particles that selectively absorb predetermined wavelengths of the visible lights.

DETAILED DESCRIPTION OF THE PRESENT INVENTION

Figure 1:
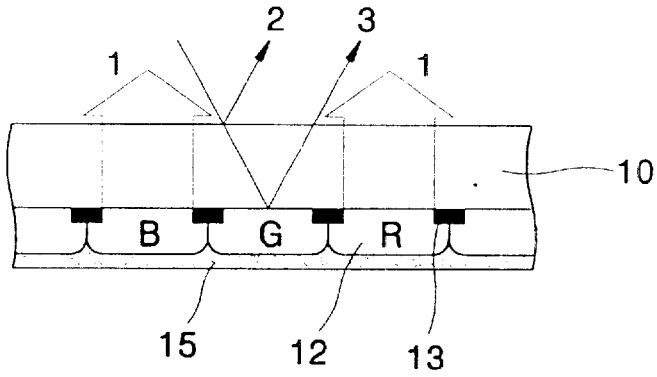
FIG.1 (PRIOR ART)
FIG. 1 is a partial cross-section of a conventional CRT face panel.
Figure 2:
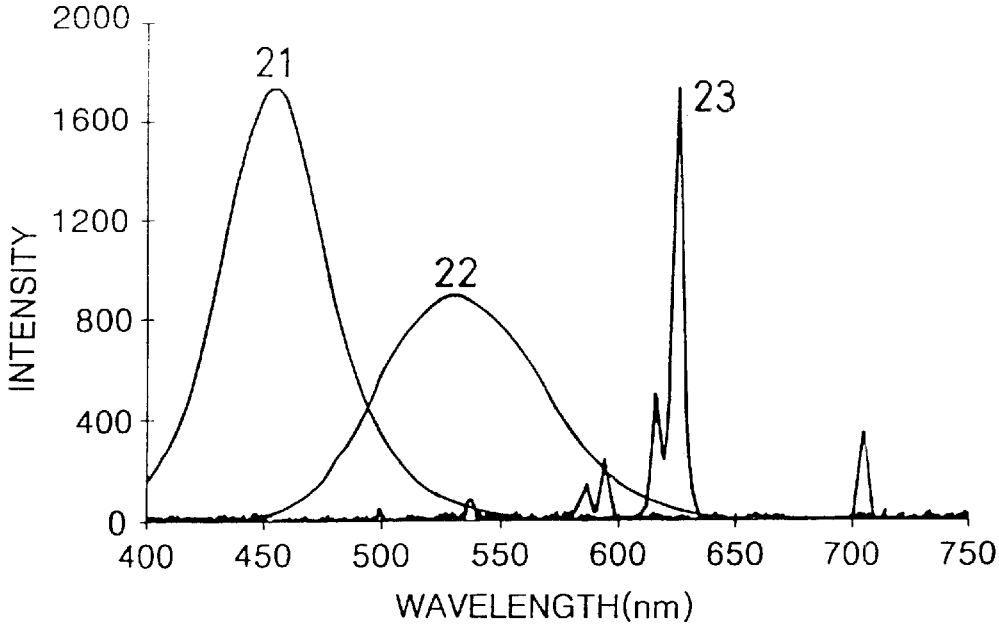
FIG.2 (PRIOR ART)
FIG. 2 is spectral luminescence distributions of conventional phosphors used on a conventional CRT face panel.
Figure 3:
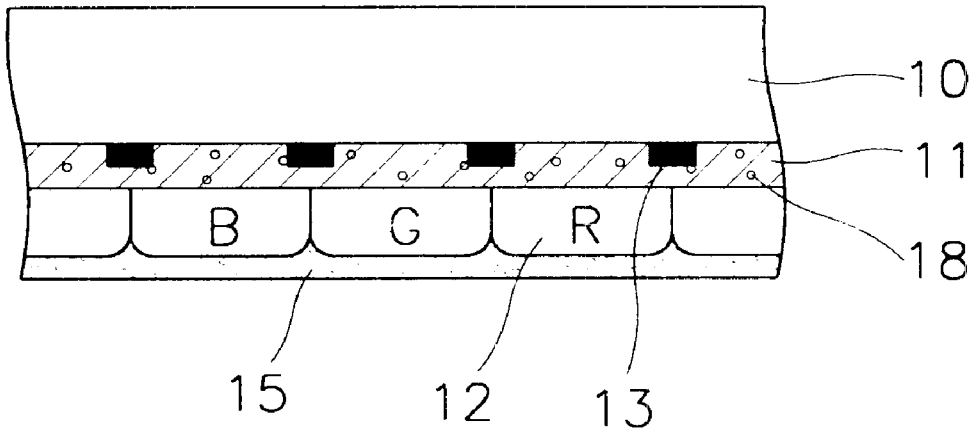
FIG. 3 is a partial cross-section of a CRT face panel according to the present invention.

FIG. 3 is a cross section of a CRT faceplate according to the present invention. The faceplate comprises a glass panel 10, a phosphor layer 12 and a filter layer 11 disposed in between. The face plate is also provided with a metal layer 15 for reflecting light emitted by the phosphor layer 12 toward the glass panel 10. Here black matrix 13 is shown formed on the inner surface of the glass panel prior to the coating of the filter layer 11. However, it may be formed after the filter layer is coated. The filter layer is a film of dielectric matrix dispersed with colored particles and minute metal particles together taking advantage of surface plasma resonance (SPR). More than one kind of metal particles and colored particles may be used for the filter layer to have a plurality of absorption peaks. Absorption peaks of metal particles and colored particles need not be the same.

SPR is a phenomenon where electrons on the surface of nano-sized metal particles in a dielectric matrix, such as silica, titania, zirconia, resonate in response to electric field and absorb light in a particular bandwidth. See J. Opt. Soc. Am. B vol.3, No. 12/December 1986, pp 1647–1655 for details. Here "nano-sized" is defined to be from several nanometers to hundreds of nanometers. In other words a "nano-sized particle" is a particle greater than 1 nanometer but less than 1 micrometer in diameter. For example, for a dielectric matrix of silica having gold (Au), silver (Ag) and copper (Cu) particles less than 100 nm in diameter light is absorbed around the wavelength of 530 nm, 410 nm and 580 nm respectively. With platinum (Pt) or palladium (Pd) light absorption spectrum is rather broad from 380 nm to 800 nm depending on the kind of matrix material. A particular wavelength absorbed depends on kinds of dielectric matrix, i.e., its refraction, kind of metal and size of such metal particles. It is known that refraction ratios of silica, alumina, ziroconia and titania are 1.52, 1.76, 2.2 and 2.5–2.7 respectively.

Kinds of metal that can be used include transition metals, alkali metals and alkali earth metals. Among them gold, silver, copper, platinum and palladium are preferred since they absorb visible light. Generally, with the size of metal particles increased until it reaches 100 nm its absorbing ratio tends to increase Above the 100 nm, as the size increases the absorption peak moves toward long wavelengths. Accordingly the size of the metal particles affects both the absorption ratio and the absorption peak wavelength.

The preferred amount of metal particles is 1–20 mol % with respect to the total mol of the dielectric matrix. Within his range desired absorption ratio and absorption peak can be selected.

A filter using silica matrix and gold particles with an absorption peak at 530 nm can be made to absorb light around 580 nm by the following methods. One is to add a second dielectric material such as Titania, Alumina or Zirconia having greater refraction so that its absorption peak moves toward longer wavelength. An added amount will determine the absorption ratio. The absorption ratio of an absorption peak should be set taking into account the transmission efficiency of a glass panel and the density of the filter. Generally absorption peak and ratio are preferred to high. Second method is to increase the size of the gold particles without addition of a second dielectric material. Because the metal particles are coated in a film using sol-gel on a surface of the glass panel the size of the metal particles can be selected by varying the amount of water, kind and amount of catalyst, and rate of temperature change in a heat treatment. For instance either the more water is added or the longer the heat treat is the larger the particles become. In addition when light around 580 nm wavelength is absorbed the light is preferably further absorbed around 410 nm to make the panel appear not bluish.

For a dielectric matrix, at least one of the group consisting of silica $SiO_2$, titania $TiO_2$, ziroconia $ZrO_2$, and alumina $Al_2O_3$. A combination of silica and titania is preferred each with 50 weight %. Another combination of ziroconia and alumina with a mole ratio of 8:2 may be used.

For colored particles dispersed in the filter layer, one or more of any known inorganic or organic dyes, or inorganic or organic pigments each having an absorption peaks in the visible light spectrum may be used. For example, $Fe_2O_3$ for red colored particles, $TiO.CoO.NiO.ZrO_2$ for green and $CoO.Al_2O_3$ for blue may be used.

FIG. 3 shows an embodiment of the present invention where the black matrix 13 is formed prior to coating of the filter. In other words, black matrix is patterned on the inner surface of a glass face panel. An SPR filter layer 11 as described for FIG. 3 is coated on top of the black matrix to completely cover the inner surface. Finally a phosphor layer 12 is formed on the filter layer, corresponding to the black matrix below. This embodiment illustrates that where the black matrix is placed is not critical in the present invention.

Figure 4:
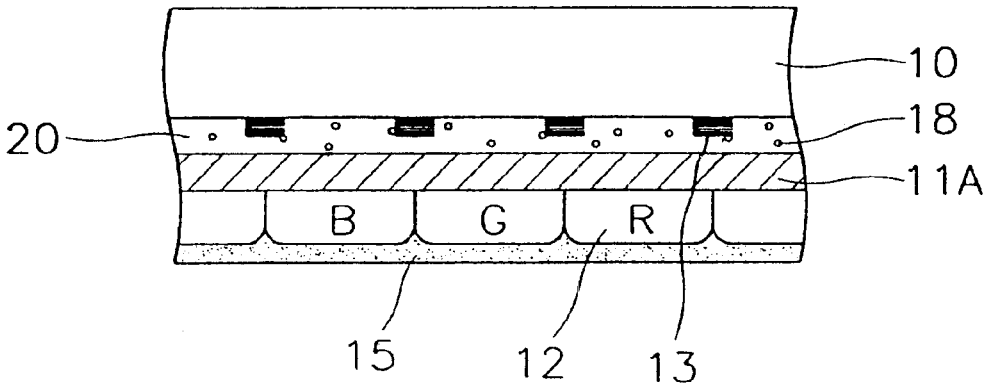
FIG. 4 is a partial cross-section of a CRT face panel according to another embodiment of the present invention.

FIG. 4 is another embodiment of the present invention where two filter layers are used where one of the two filters is dispersed with metal particles (11*a*) while the other is dispersed with colored particles (18). Though a colored filter layer 20 is shown coated on the inner surface of the glass panel 10, the metal particles layer 11*a* may be first coated on the inner surface of the glass panel. Further the filter may be comprised of more than two layers with additional layers having different absorption peaks, at around 500 nm, for example, at which both green and blue phosphors are luminescent.

Figure 5:
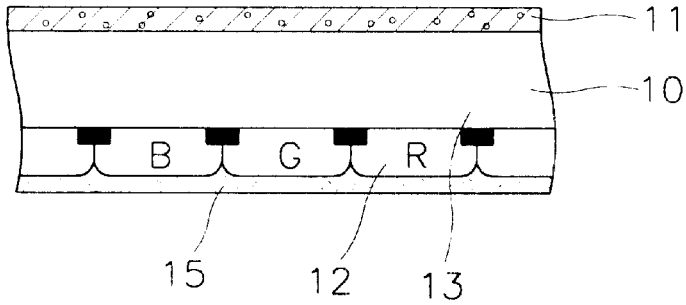
FIG. 5 is a partial cross-section of a CRT face panel according to another embodiment of the present invention.

FIG. 5 illustrates a filter layer 11 dispersed with minute metal particles and colored particles on the outer surface of the glass panel for reducing light reflection off the outer surface. Though not shown in the drawings more than one filter layer can be applied on the outer surface, having absorption peaks at different wavelengths.

FIG. 5 illustrates a filter layer dispersed with minute metal particles and colored particles on the outer surface of the glass panel for reducing light reflection off the outer surface. Though not shown in the drawings more than one filter layer can be applied on the outer surface, having absorption peaks at different wavelengths.

Figure 6:
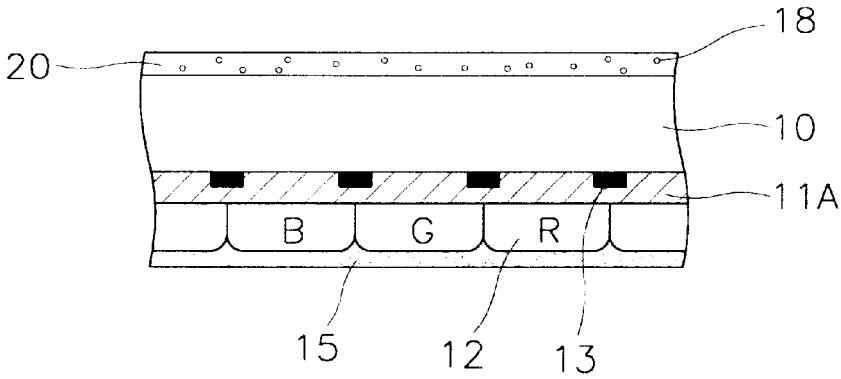
FIG. 6 is a partial cross-section of a CRT face panel according to another embodiment of the present invention.
Figure 7:
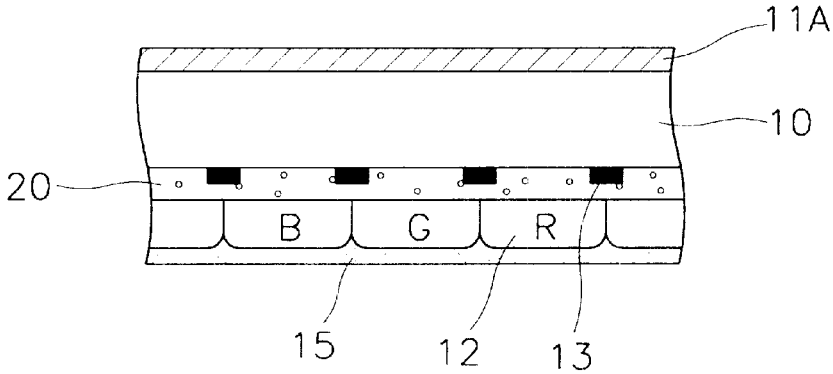
FIG. 7 is a partial cross-section of a CRT face panel according to another embodiment of the present invention.

FIG. 6 shows a colored filter layer 20 coated on the outer surface of a glass panel and a metal-particle layer 11*a* on the inner surface. As shown in FIG. 7 the two layers can be interchanged.

Figure 8:
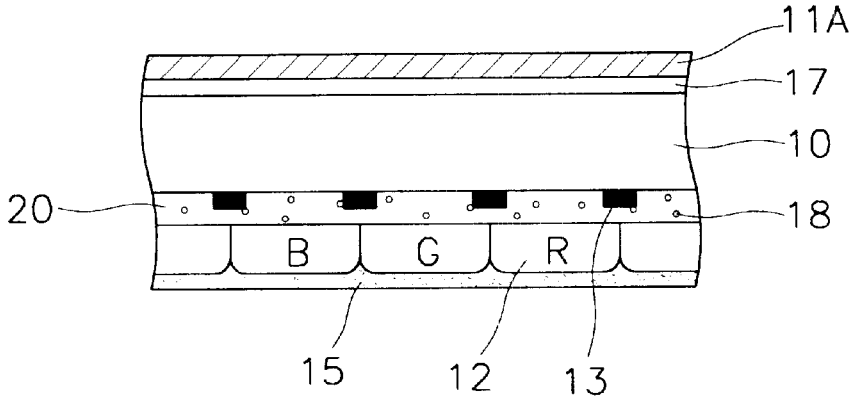
FIG. 8 is a partial cross-section of a CRT face panel according to another embodiment of the present invention.

FIG. 8 shows a face panel of FIG. 7 where a conductive layer 17 is coated on the outer surface of the glass panel before a protection film 11*a*. The conductive film 17 prevents static and a protection layer 11*a* both protects the panel from scratches and reduces light reflection. Generally the conductive film 17 includes indium tin oxides (ITO) and the protection layer is made of silica. According to the present invention minute metal particles are added to silica sol prior to forming of the silica protection layer. Thus the protection layer serves an extra function of selective light absorption.

Figure 9:
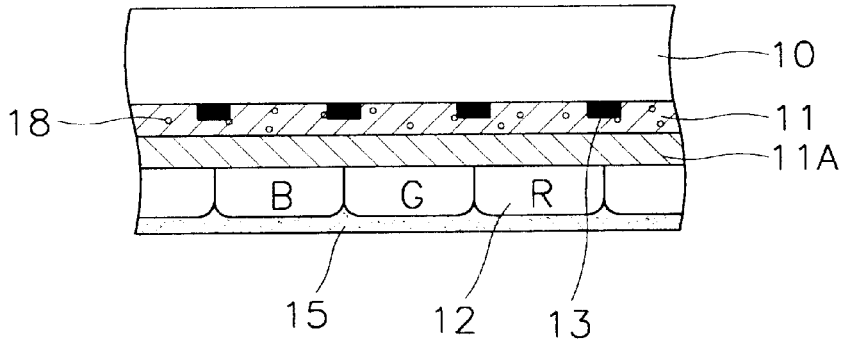
FIG. 9 is a partial cross-section of a CRT face panel according to another embodiment of the present invention.
Figure 10:
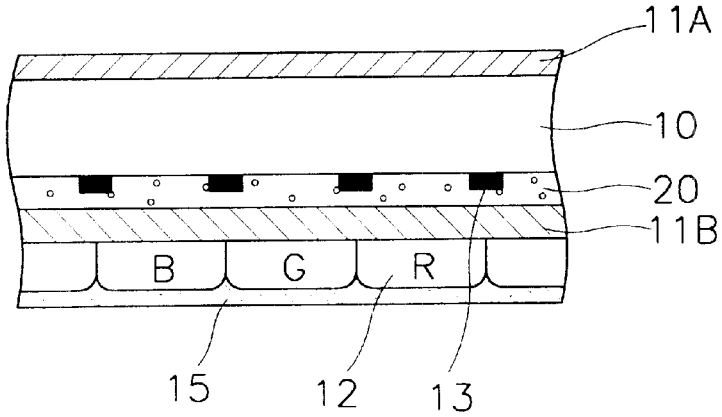
FIG. 10 is a partial cross-section of a CRT face panel according to the present invention.

FIG. 9 shows another embodiment of the present invention similar to that of FIG. 3 where an additional layer 11*a* having solely colored particles or metal particles is arranged between the mixed metal/colored particles filter layer 11 and the phosphor layer 12. The embodiment as shown in FIG. 10 shows a filter layer structure where metal particle layers 11*a*, 11*b* are formed on the outer surface of the glass panel and on the inner surface of the colored particle layer 20 respectively. In other words these embodiments show various combinations of mixed state filter layer, metal particle layer and colored particle layer.

EXAMPLES

Example 1

4.5 g of tetra-ortho-silicate (TEOS) was dispersed in a solvent consisting of 30 g of reagent methanol, 30 g of ethanol, 12 g of n-buthanol and 4 g of deionized water. 0.5 g of $HAuCl_4 4H_2O$ was added to thus dispersed solvent, which was subsequently stirred at the room temperature for 24 hours to prepare a solution A.

36 g of ethanol, 1.8 g of deionized water, 2.5 g of hydrochloric acid (35% density) were added one by one to 25 g of titanium iso-propoxide (TIP) and the mixture was stirred at the room temperature for 24 hours to prepare a solution B.

A coating material was prepared by mixing 12 g of solution A, 3 g of solution B, 12 g of ethanol, 0.064 g of red pigment $Fe_2O_3$, 1 g of blue pigment $CoO.Al_2O_3$ and 6 g of dimethylformamide such that the mixture had 12 mol % of gold and the mol ratio of titania to silica was 1:1.

50 ml of the coating material was spin-coated on a 17-inch CRT face panel spinning at 150 rpm. The coated panel was heated at 450° C. for 30 minutes.

The thus-made panel had an absorption peak at 580 nm as shown in FIG. 3. The contrast, brightness and endurance were tested satisfactory.

Example 2

A metal salt $HAuCl_4$ was replaced by $NaAuCl_3$ with other things being equal to those of Example 1.

Example 3

$HAuCl_4$ was replaced by $AuCl_3$ with other things being equal to those of Example 1.

Example 4

A same CRT was made with tetra-ortho-silicate (TEOS) and titanium iso-propoxide (TIP) of Example 1 replaced by $Zr(OC_2H_5)_4$ and sec-$Al(OC_4H_9)_4$ such that the mole ratio of ziroconia to alumina was 4:1.

Example 5

The coating material of Example 1 was coated on the outer surface of a face panel and the coated panel was heated at a temperature of 200–250° C. while other manufacturing process is equal to that of Example 1.

Example 6

The coated panel made in Example 5 was preheated at 100° C. and pure water and hydrazine, with a ratio of 9:1 in weight % was additionally coated and heated at 200° C.

Example 7

$HAuCl_4$ was replaced by $NaAuCl_4$ with other things being equal to those of Example 5.

Example 8

$HAuCl_4$ was replaced by $NaAuCl_4$ with other things being equal to those of Example 6.

Example 9

2.5 g of Indium Tin Oxide (ITO) having an average particle diameter of 80 nm was dispersed in a solvent consisting of 20 g of methanol, 67.5 g of ethanol and 10 g of n-butanol to prepare a first coating material.

A second coating material was prepared by mixing 12 g of solution A, 3 g of solution B, as used in Example 1, and 12 g of ethanol.

A third coating material was prepared by first mixing 23.6 g of deionized water, 2.36 g of diethylglycol, 3.75 g of blue pigment $CoO.Al_2)_3$, 0.245 g of red pigment $Fe_2O_3$ and adding to the mixture 3 g of 10% potassium silicate, small amounts of surfactant, such as sodium salt of polymeric carboxylic acid (OROTAN® made by Rohm & Haas Co) or sodium citrate (SCA), and antifoaming agent such as polyoxypropylene or polyoxyethylene copolymer (PES). The amount of OROTON or SCA may be 0.1–0.5 W % of pigments, preferably 0.24 W % and 0.16 W % respectively. A combination of these two may be used. As to PES, an amount of 0.05 W % of the solvent may be used, preferably 0.1 W % of the solvent.

Next 50 ml of the first coating material was spin coated on the outer surface of the glass panel before 50 ml of the second coating material was coated. The third coating material was coated on the inner surface of the glass panel as shown in FIG. 8.

Example 10

The double-coated panel made in Example 9 was preheated at 100° C. and de-ionized water and hydrazine, with a ratio of 9:1 in weight % was additionally coated and heated at 200° C.

Example 11

Metal salt $HAuCl_4$ was replaced by $NaAuCl_4$ with other things being equal to those of Example 9.

Example 12

$HAuCl_4$ was replaced by $NaAuCl_4$ with other things being equal to those of Example 10.

CRT face panels of Examples 1–12 all had absorption peaks at 580 nm and 410 nm while contrast, brightness and endurance were tested satisfactory.

Example 13

A new coating material as the same as that in Example 1 was prepared except that $HAuCl_4$ was replaced with $AgNO_3$ and silver content was 5 mol %. The coating material of Example 1 was spin-coated on the inner surface of a CRT face panel and the new coating material was spin-coated on top of the first coating while all other manufacturing process is equal to that of Example 1 for the purpose of providing an embodiment of the present invention as shown in FIG. 9. The resultant CRT face panel had main absorption peaks at 410 nm and 580 nm with contrast, brightness and endurance satisfactory.

Example 14

A same CRT of Example 1 was made except for $HAuCl_4 4H_2O$ and $AgNO_3$ such that the amounts of gold and silver becomes 12 mol % and 5 mol % respectively.

The resultant CRT face panels of Example 13 and 14 each had main absorption peaks at 410 nm and 580 nm with contrast, brightness and endurance satisfactory.

What is claimed is:

1. A cathode ray tube (CRT) comprising:

a glass panel, and at least one essentially dielectric filter layer, coated on at least one surface of said glass panel, said at least one filter layer being formed of a dielectric matrix with nano-sized minute metal particles and colored particles dispersed therein, and having at least one absorption peak at a predetermined wavelength.

2. The CRT according to claim 1, wherein said metal particles are of at least one metal selected from the group consisting of gold, silver, copper, platinum and palladium.

3. The CRT according to claim 2, wherein said at least one filter layer includes at least two kinds of metal particles from said group such that said at least one filter layer has more than one absorption peak.

4. The CRT according to claim 2, wherein said nano-sized minute metal particles are of a single metal selected from said group.

5. The CRT according to claim 1, wherein said metal particles are in the amount of 1–20% mole with respect to said dielectric matrix.

6. The CRT according to claim 5, wherein said metal particles are in the amount of less than 10% mole with respect to said dielectric matrix.

7. The CRT according to claim 1, wherein said dielectric matrix is of at least one dielectric selected from the group consisting of silica, titania, ziroconia and alumina.

8. The CRT according to claim 7, wherein said dielectric matrix comprises a combination of silica and titania in a mole ratio of 1:1.

9. The CRT according to claim 7, wherein said dielectric matrix comprises a combination of ziroconia and alumina in a mole ratio of 8:2.

10. The CRT according to claim 1, wherein said colored particles are selected from the group consisting of inorganic pigments, inorganic dyes, organic pigments and organic dyes.

11. The CRT according to claim 10, wherein said at least one filter layer includes at least two kinds of colored particles from said group such that said at least one filter layer has more than one absorption peak.

12. The CRT according to claim 1, further comprising an additional filter layer dispersed with nano-sized minute metal particles only, and coated on top of said at least one filter layer.

13. A cathode ray tube (CRT) comprising:

a glass panel, and at least first and second filter layers, coated on at least one surface of said glass panel, wherein the first filter layer is essentially dielectric and is formed of a dielectric matrix with nano-sized minute metal particles dispersed therein, and the second filter layer includes colored particles such that said first and second filter layers have at least one light absorption peak at a predetermined wavelength.

14. The CRT according to claim 13, wherein said metal particles are of at least one metal selected from the group consisting of gold, silver, copper, platinum and palladium.

15. The CRT according to claim 14, wherein said first filter layer includes at least two kinds of metal particles from said group such that said first filter layer has more than one absorption peak.

16. The CRT according to claim 14, wherein said nano-sized minute metal particles are of a single metal selected from said group.

17. The CRT according to claim 13, wherein said metal particles are in the amount of 1–20% mole with respect to said dielectric matrix.

18. The CRT according to claim 17, wherein said metal particles are in the amount of less than 10% mole with respect to said dielectric matrix.

19. The CRT according to claim 13, wherein said dielectric matrix is of at least one dielectric selected from the group consisting of silica, titania, ziroconia and alumina.

20. The CRT according to claim 19, wherein said dielectric matrix comprises a combination of silica and titania in a mole ratio of 1:1.

21. The CRT according to claim 19, wherein said dielectric matrix comprises a combination of ziroconia and alumina in a mole ratio of 8:2.

22. The CRT according to claim 13, wherein said colored particles are selected from the group consisting of inorganic pigments, inorganic dyes, organic pigments and organic dyes.

23. The CRT according to claim 22, wherein said second filter layer includes at least two kinds of colored particles from said group such that said second filter layer has more than one absorption peak.

24. The CRT according to claim 13, wherein said first and second layers are coated on a same surface of said glass panel.

25. The CRT according to claim 24, wherein an additional filter layer having minute metal particles dispersed therein is coated on a surface of said glass panel opposite to said same surface.

26. The CRT according to claim 13, wherein said first and second filter layers are coated on opposite surfaces of the glass panel.

27. The CRT according to claim 26, wherein a conductive film including indium tin oxide is arranged between said first filter layer and one of said opposite surfaces of the glass panel.

* * * * *